United States Patent [19]

Nanjo et al.

[11] 4,270,510

[45] Jun. 2, 1981

[54] IGNITION SYSTEM FOR AN INTERNAL COMBUSTION ENGINE

[75] Inventors: Hirotoshi Nanjo; Toshikazu Tsuji, both of Susono, Japan

[73] Assignee: Kokusan Denki Co., Ltd., Shizuoka, Japan

[21] Appl. No.: 59,331

[22] Filed: Jul. 20, 1979

[30] Foreign Application Priority Data

Jul. 28, 1978 [JP] Japan ..... 53/103057[U]

[51] Int. Cl.[3] ..... F02P 1/08

[52] U.S. Cl. ..... 123/648; 123/149 D

[58] Field of Search ..... 123/148 E, 148 CB, 148 CC, 123/148 CA, 148 AC, 149 A, 149 D; 315/209 T, 209 SC, 209 CD, 218

[56] References Cited

U.S. PATENT DOCUMENTS

| | | | |
|---|---|---|---|
| 3,078,391 | 2/1963 | Bunodiere et al. | 315/209 SC |
| 3,134,048 | 5/1964 | Wolfframm et al. | 315/209 SC |
| 3,169,212 | 2/1965 | Walters | 123/148 CA |
| 3,864,621 | 2/1975 | Haubner et al. | 123/148 E |
| 3,878,452 | 4/1975 | Haubner et al. | 123/148 E |
| 3,938,491 | 2/1976 | Mazza | 123/148 E |
| 3,958,546 | 5/1976 | Ohki et al. | 315/209 SC |
| 3,963,015 | 6/1976 | Haubner et al. | 123/148 CC |
| 3,974,815 | 8/1976 | Katsumatal | 123/148 CC |
| 4,173,961 | 11/1979 | Howard | 123/148 E |
| 4,173,963 | 11/1979 | Heuwieser et al. | 123/149 D |

FOREIGN PATENT DOCUMENTS

| | | | |
|---|---|---|---|
| 2242326 | 3/1974 | Fed. Rep. of Germany | 123/148 CC |

*Primary Examiner*—P. S. Lall

*Attorney, Agent, or Firm*—Pearne, Gordon, Sessions, McCoy & Granger

[57] ABSTRACT

An ignition system for an internal combustion engine having a transistor switch means connected across a primary winding of an ignition coil wherein a base current input terminal of the transistor switch means is connected through a coil to an igniting exciter coil to supply a base current through the coil to the base current input terminal thereby decreasing a power loss at the interruption of a primary current flowing through an ignition coil and operating a transistor in a low power loss region, so that a high voltage may be induced across a secondary winding of an ignition coil.

13 Claims, 6 Drawing Figures

IGNITION SYSTEM FOR AN INTERNAL COMBUSTION ENGINE

BACKGROUND OF THE INVENTION

This invention relates to an ignition system for an internal combustion engine, and more particularly to an ignition system capable of causing a high voltage to be induced across a secondary winding of an ignition coil when a transistor switch means which is connected across a primary winding of the ignition coil is made non-conductive at an ignition position of an engine.

A prior art ignition system of such type is generally constructed in such a manner as shown in FIG. 1. In FIG. 1, reference numeral 10 designates an ignition coil including a primary winding 11 and a secondary winding 12; reference numeral 14 indicates an ignition plug attached through the both ends of the secondary winding 12 to a cylinder of an engine; and reference numeral 16 designates a npn-transistor forming a transistor switch means. A collector of the transistor 16 is connected to one end of the primary winding 11 of the ignition coil 10, and an emitter thereof is connected to the other end of the primary winding 11 through a diode 18, the diode 18 having an anode connected to the emitter. The transistor 16 is also connected through a base thereof to one end of a resistor 20, and a resistor 22 is connected between the other end of the resistor 20 and the collector of the transistor 16. The resistors 20 and 22 are connected to an anode of a thyristor 24 through a coupling point therebetween, and a cathode of the thyristor 24 is connected to a cathode of the diode 18. A resistor 26 is connected across a gate of the thyristor 24 and the cathode thereof, and a signal generating coil 28 is also coupled across the gate and cathode of the thyristor 24.

In the prior art ignition system as shown in FIG. 1, the ignition coil is conventionally disposed on a stator of an AC magnetic generator operated by an internal combustion engine. That is, the primary winding 11 also serves as an igniting exciter coil, so that an AC voltage may be induced across the primary winding 11 in synchronism with the rotation of the engine. The signal generating coil 28 is disposed in a signal coil which generates a signal by utilizing magnetic flux from the magnetic poles of a rotator of the magneto generator or in a signal generator provided separately from the magneto generator, and the coil 28 acts to generate a turn-on signal for making the thyristor 24 conductive at an ignition position of the engine. When a half-cycle of voltage is induced across the primary winding 11 in the direction of the arrow along the solid line of FIG. 1 correspondingly to the rotation of an output shaft of the engine, a base current flows from the primary winding 11 through the resistors 22 and 20 to the base of the transistor 16; so that the transistor 16 is made conductive to permit a current to flow from the primary winding 11 through a collector-emitter circuit of the transistor 16 and the diode 18. Then, when an output voltage of the signal generating coil 28 reaches a trigger level of the thyristor 24 at an ignition position of the engine, the thyristor 24 becomes conductive to prevent a current from flowing to the base of the transistor 16 and to cause the current to be by-passed through the thyristor 24. Thus, a base current to the base of the transistor 16 is interrupted. This causes the transistor 16 to be made non-conductive, so that a current flowing across the primary winding 11 is suddenly decreased, to thereby cause the change of magnetic flux across the primary winding. Such change of magnetic flux allows a high voltage to be induced across the secondary coil 12, so that the ignition plug 14 generates a spark between electrodes thereof to permit the engine to be ignited.

In the prior art ignition system constructed as mentioned above, an impedance between the collector and emitter of the transistor 16 decreases when the transistor 16 is conductive, so that the voltage across the primary winding 11 decreases to 2 to 3 V. This means that the resistor 22 should have a sufficiently low resistance to flow a base current enough to keep the transistor conductive. Therefore, when the thyristor 24 and the transistor 16 are made conductive and non-conductive respectively to induce a voltage across the primary winding 11 in the direction of the arrow along the solid line of FIG. 1, the voltage causes a considerable amount of current to flow through the resistor 22 and the thyristor 24; as a result thereof, the ignition performance of the system is adversely affected. The reason is that a secondary voltage induced across the secondary coil 12 and a spark energy are determined by a ratio of a change of the primary current (di) flowing through the primary winding 11 to a time (dt) "dt/dt" and by the amount of change of the primary current. Therefore, in the prior art ignition system, to induce a sufficiently high voltage across the secondary winding 12 and to supply a high spark energy, it is to be desired that the primary current flowing through the primary winding 11 rapidly decreases to zero at a transient time when the transistor 16 becomes non-conductive. However, since a large current flows through a circuit consisting of the resistor 22 and the thyristor 24 at a transient time when the transistor 16 is made non-conductive, the primary current does not decrease to zero; the primary current decreases to a value of a current determined by an impedance of the circuit consisting of the resistor 22 and the thyristor 24. As the result thereof, since the amount of change of the primary current and the di/dt decrease, both the spark energy and the secondary voltage also decrease so that the ignition performance is adversely affected. In addition, such prior art ignition system has another disadvantage that the transistor 16 is difficult to be operated in a low power loss region because it is impossible to flow a larger base current through the base of the transistor 16. In general, in order to operate a transistor in a low power loss region with a relatively small base current, the transistor is required to have a very large amplification factor. While, a transistor to be used in such ignition system is required to have characteristics of withstanding a high voltage induced across the primary winding 11 at the interruption of a primary current. In this connection, because a transistor of a high withstand voltage generally has a low amplification factor, it is very difficult to obtain a transistor having a high withstand voltage as well as a high amplification factor, thus, an ignition system including such transistor has a disadvantage to become expensive.

SUMMARY OF THE INVENTION

Accordingly, an object of the present invention is to provide an ignition system for an internal combustion engine capable of remarkably decreasing a power loss at the interruption of a primary current flowing through an ignition coil.

Another object of the present invention is to provide an ignition system adapted to operate a conventional transistor incorporated therein in a low power loss region.

An ignition system for an internal combustion engine according to the present invention comprises an ignition exciter coil; an ignition coil including primary and secondary windings; a transistor switch means having a base current input terminal and connected across the primary winding of the ignition coil, the transistor switch means being made conductive when a base current is supplied from the igniting exciter coil to the base current input terminal; a semiconductor switch connected to provide a by-pass in shunt with the base current input terminal when the semiconductor switch is made conductive; and a turn-on signal generating circuit for supplying a turn-on signal to the semiconductor switch at an igniting position of the engine. The ignition system is characterized in that the base current input terminal of the transistor switch means is connected through a coil to the igniting exciter coil so as to supply the base current through the coil to the base current input terminal.

BRIEF DESCRIPTION OF THE DRAWINGS

Other features and advantages of the present invention will be apparent from the following description taken in connection with the accompanying drawings in which.

In the drawings illustrating various embodiments of the present invention, like reference numerals designate like or corresponding parts therethrough.

DETAILED DESCRIPTION OF THE PREFERRED EMBODIMENTS

Figure 1:
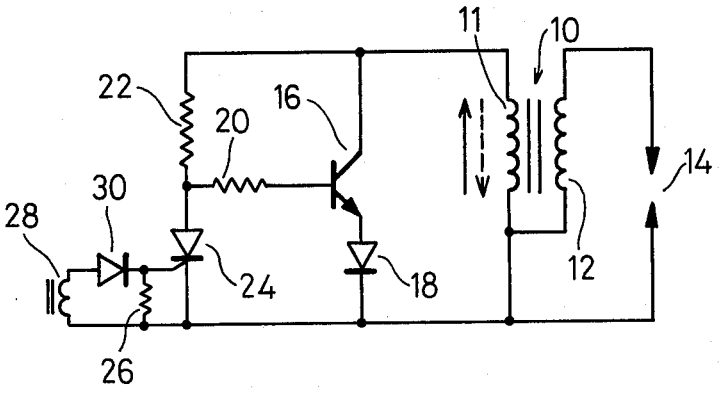
FIG. 1 PRIOR ART
FIG. 1 is a circuit diagram illustrating a general construction of a conventional ignition system.
Figure 2:
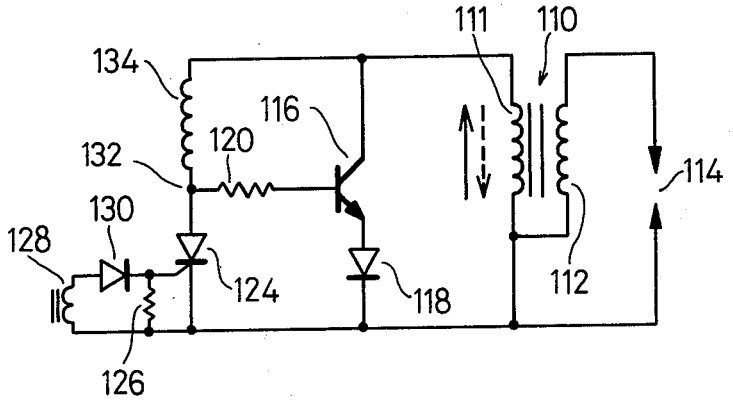
FIG. 2 is a circuit diagram showing one embodiment of the present invention.

Referring first to FIG. 2 showing one embodiment of the present invention, reference numeral 110 designates an ignition coil including a primary winding 111 and a secondary winding 112, and reference numeral 114 designates an ignition plug. Reference numeral 116, 118 and 120 designate a npn-transistor, a diode and a resistor respectively, which are adapted to form a transistor switch means in cooperation with one another. One end of the resistor 120 is connected to a base of the transistor 116 and the other end thereof serves as a base current input terminal 132. Reference numeral 124 designates a thyristor constructed to serve as a semiconductor switch through which a base current to be directed to a base current input terminal of the transistor switch means is by-passed from a base of the transistor switch. Reference numerals 126, 128 and 130 designate a resistor, a signal generating coil and a diode respectively, which form in cooperation with one another a turn-on signal generating circuit for supplying a turn-on signal to the thyristor 124 acting as the semi-conductor switch.

A feature of the ignition system shown in FIG. 2 is in that the base current input terminal 132 of the transistor switch means is coupled through a coil 134 to one end of the primary winding 111 serving as an igniting exciter coil connected to a collector of the transistor 116.

The ignition system as shown in FIG. 2 is constructed in such a manner that when a voltage is induced across the primary winding 111 in the direction of the arrow along the solid line, a base current flows from the primary winding 111 through the coil 134 and the resistor 120 to the base of the transistor 116, to thereby allow the transistor 116 to be made conductive. In this case, an impedance Z of the coil 134 is represented by the following equation:

$$Z=\sqrt{R^2+(\omega L)^2}$$

wherein

L is an inductance of the coil,

R is a resistance of the coil, and $\omega$ is an angular frequency.

When the transistor 116 is in the conductive state, the angular frequency $\omega$ is a function of frequency of an output voltage of a magneto generator, the frequency being substantially determined by the number of magnetic poles and the number of rotations per minute of the magneto generator; and generally, the angular frequency $\omega$ is small in value sufficient to be neglected. Thus, the impedance Z of the coil may be expressed by the following equation:

$$Z=\sqrt{R^2+(\omega L)^2}\approx R.$$

Because the resistance R of the coil 134 is very small, a very large base current flows through the base of the transistor even if a voltage across the primary winding 111 decreases due to the turn-on of the transistor 116, so that the transistor 116 may be operated in a low power loss region. Therefore, it will be noted that the ignition system of the present invention is not required to employ a special transistor having a large amplification factor.

In addition, at a transient time when the transistor 116 becomes non-conductive, the angular frequency becomes large in value because a voltage induced across the primary winding 111 has a very short rise time of the order of 10 to 50 $\mu$sec.; and this causes the coil 134 to have a very large impedance. Accordingly, at a transient time when the transistor 116 becomes non-conductive, a current flowing through the primary winding 111, the coil 134 and thyristor 124 markedly decreases to a minimum current which is only slightly greater than the holding current of the thyristor 124, so that both the decrease of a changing amount of the primary current and the decrease of ratio of the change of the primary current to a time "di/dt" are prevented. Thus, according to the present invention, both the spark energy and the secondary voltage induced across the secondary winding 112 do not decrease, so that the ignition performance is not adversely affected.

Figure 3:
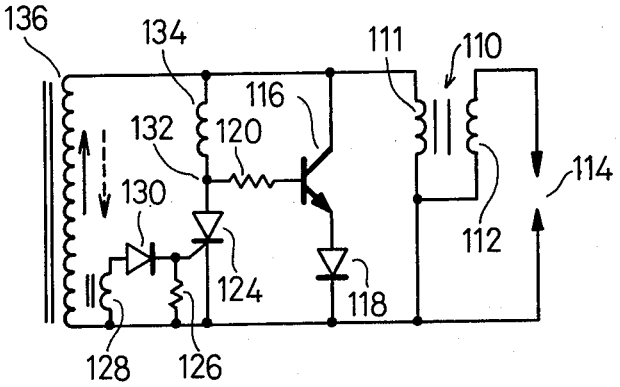
FIG. 3 is a circuit diagram showing another embodiment of the present invention.

FIG. 3 shows another embodiment of the present invention wherein an igniting exciter coil 136 is provided on a stator of an AC magneto generator operated by an engine, separately from an ignition coil 110; and the ignition coil 110 is disposed at the exterior of the magneto generator. The igniting exciter coil 136 is connected across a primary winding 111, and a coil 134 is connected between the coupling point of a collector of a transistor 116 with the exciter coil 136 and a base current input terminal 132 of the transistor 116. The remaining is constructed in such a manner as the embodiment shown in FIG. 2.

In the ignition system as shown in FIG. 3, when a voltage is induced across the igniting exciter coil 136 in the direction of the arrow along the solid line, a current flows from the exciter coil 136 through a coil 134 and the resistor 120 to a base of the transistor 116 to make the transistor 116 conductive, so that a current may flow from the exciter coil 136 through the transistor 116 and a diode 118. Then, when a thyristor 124 is made conductive at an ignition position to make the transistor 116 non-conductive, a high voltage is induced across the exciter coil 136 in the direction of the arrow along the solid line to thereby cause a current to suddenly flow across the primary winding 111. Such sudden change of current in the primary winding 111 allows a high voltage to the induced across a secondary winding 112, so that an ignition plug 114 may generate a spark to ignite an engine.

Figure 4:
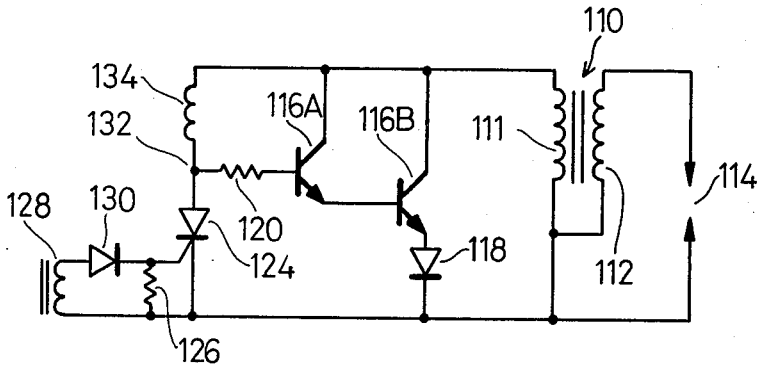
FIG. 4 is a circuit diagram showing a further embodiment of the present invention.

FIG. 4 shows a further embodiment of the present invention wherein a transistor switch means is formed by two transistors 116A and 116B in a Darlington arrangement, a diode 118, and a resistor 120. The remaining is constructed in such a manner as the embodiment shown in FIG. 2. However, in the present invention, so far as a transistor switch means is adapted to act as a switch circuit which is conductive upon supplying a base current from a power supply to the transistor switch means, it may be formed by more transistors.

Figure 5:
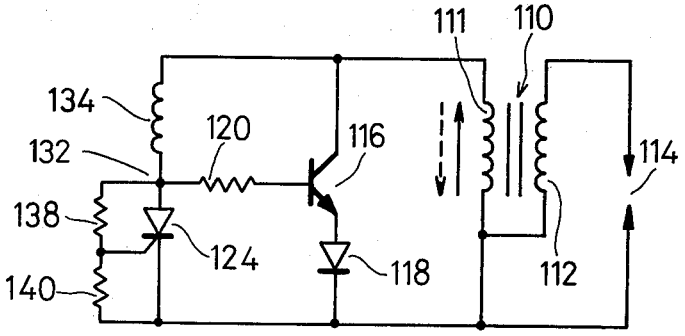
FIG. 5 is a circuit diagram showing still a further embodiment of the present invention.

FIG. 5 shows still a further embodiment of the present invention wherein an igniting position of an engine is determined on the basis of the change of a voltage caused by dividing an output voltage of an igniting exciter coil. In this embodiment, a turn-on signal generating circuit is formed by a divider circuit consisting of resistors 138 and 140 connected to each other in series, which are connected across an anode and a cathode of a thyristor 124. The coupling point between the resistors 138 and 140 is connected to a gate of the thyristor 124. The remaining of the ignition system shown in FIG. 5 is constructed in such a manner as the ignition system shown in FIG. 2.

The operation of the ignition system as shown in FIG. 5 will now be explained.

When a half-cycle of voltage is induced across a primary winding 111 in the direction of the arrow along the solid line, a transistor 116 is made conductive. Then, when the voltage across the primary winding reaches a predetermined level, a gate signal is supplied to the thyristor 124 to make the thyristor 124 conductive, so that the transistor 116 may be made non-conductive to allow an ignition plug to generate a spark.

Figure 6:
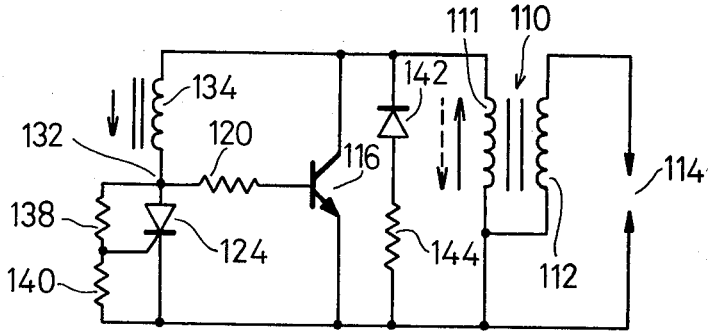
FIG. 6 is a circuit diagram showing an even further embodiment of the present invention.

FIG. 6 shows an even further embodiment of the present invention wherein a coil 134 which connects a base current input terminal of a transistor switch means to a power supply is utilized as a signal generating coil. The coil 134 is wound onto an armature core and is disposed in a magneto generator on which an ignition coil 110 is placed or in a signal generator provided separately from the magneto generator. Across the signal coil 134 is induced a signal voltage in synchronism with the rotation of an engine, and the signal voltage is preferably of one cycle per one rotation of an output shaft of the engine. In this embodiment, a collector-emitter circuit of a transistor 116 is directly connected across a primary winding 111; and further, a diode 142 and a resistor 144 coupled with each other in series are connected across a collector and an emitter of the transistor 116, the diode 142 being connected across the transistor 116 in the direction to flow a current through the series circuit of the diode 142 and the resistor 144 when a voltage is induced across the primary winding 111 in the direction of the arrow along the dotted line. The remaining of this embodiment is constructed in such a manner as the embodiment of FIG. 5.

In this embodiment, when a voltage is induced across the primary winding 111 disposed in the magneto generator in the direction of the arrow along the solid line, a base current flows from the primary winding 111 through the coil 134 and a resistor 120 to the transistor 116 to permit the transistor 116 to be made conductive. Due to such half-cycle of voltage induced across the primary winding 111 in the direction of the arrow of the solid line, a voltage is induced across the coil 134 which has a polarity of the direction of the arrow along the solid line. When the sum of the voltage across the primary winding 111 and the voltage across the coil 134 reaches a predetermined level, a voltage applied between the both ends of a resistor 140 reaches a gate trigger level of a thyristor 124 to cause the thyristor to be made conductive, so that the transistor 116 may be made non-conductive to allow an ignition plug 114 to generate a spark sufficient to ignite an engine.

In the embodiments as mentioned above, the resistor 120 also acts to prevent a base current from flowing into the transistor 116 due to the forward voltage drop of the thyristor 124 after the transistor 116 has been made non-conductive. In the embodiments of FIGS. 2 to 5, the diode 118 serves to prevent the damage of the transistor 116 caused due to a voltage induced across the primary winding 111 or a voltage induced across the igniting exciter coil 136 in the direction of the arrow along the dotted line. In addition, in the embodiment of FIG. 6, the diode 142 and the resistor 144 connected to each other in series act to decrease a reverse voltage occurring when a voltage induced across the primary winding 111 in the direction of the arrow along the dotted line is applied between the collector of the transistor 116 and the emitter thereof, to thereby prevent the damage of the transistor 116.

In the embodiment shown in FIG. 3, the igniting exciter coil 136 is provided separately from the ignition coil 110, in which the ignition system of FIG. 3 is different from that of FIG. 2. It is of course that such igniting exciter coil may be provided separately from the ignition coil in the embodiments of FIGS. 4 and 5. Further, in each embodiment, another semiconductor switch such as a switch in which a transistor is used may be substituted for the thyristor.

According to the present invention, as described above, the base current input terminal of the transistor switch means for controlling the primary current of the ignition coil is coupled through the coil to the igniting exciter coil, so that a base current may be supplied through the coil to the transistor switch means. Thus, when the transistor switch means is made conductive, a very large base current may be supplied to the transistor switch means to operate the transistor switch means in a low power loss region.

Further, at a transient time when the transistor is made non-conductor, the impedance of the coil increases to cause a marked decrease in the current flowing through the primary winding of the ignition coil, the coil and the semiconductor switch for making the transistor switch means non-conductive, so that the ignition performance is not adversely affected.

As many apparently widely different embodiments of the present invention may be made without departing from the spirit and scope thereof, it is to be understood that the invention is not limited to the specific embodiments thereof except as defined in the appended claims.

What is claimed is:

1. An ignition system for an internal combustion engine comprising an igniting exciter coil; an ignition coil including a primary winding and a secondary winding; a transistor switch means having a base current input terminal and connected across the primary winding of the ignition coil, the transistor switch means being made conductive when a base current is supplied from the igniting exciter coil to the base current input terminal; a semiconductor switch connected to by-pass a base current to be suppllied to the transistor switch means from the base current input terminal when the semiconductor switch is turned on; and a turn-on signal generating circuit for supplying a turn-on signal to the semiconductor switch at an igniting position of the engine;

characterized by further comprising a coil through which said base current input terminal of said transistor switch means is connected to the igniting exciter coil, so that the base current is supplied through said coil to said base current input terminal.

2. An ignition system as defined in claim 1 wherein said ignition coil is disposed in a magneto generator operated by the engine so that a voltage is induced across said primary winding of said ignition coil, and said primary winding also serves as said igniting exciter coil.

3. An ignition system as defined in claim 1 wherein said igniting exciter coil is disposed in a magneto generator operated by the engine and is connected across said primary winding of said ignition coil.

4. An ignition system as defined in claim 1 wherein said transistor switch means consists of a npn-transistor and a resistor connected to a base of said transistor.

5. An ignition system as defined in claim 1 wherein said transistor switch means comprises a plurality of transistors in a Darlington arrangement and a resistor connected to a base of a first stage transistor of said transistors.

6. An ignition system as defined in claim 1 wherein said transistor switch means is coupled across said ingiting exciter coil through a diode positioned in the direction to interrupt a reverse voltage.

7. An ignition system as defined in claim 1 wherein said transistor switch means is directly connected across said igniting exciter coil, and a series circuit consisting of a resistor and a diode disposed in the direction to flow a current when a reverse voltage is induced is connected across said transistor switch.

8. An ignition system as defined in claim 4 or 5 wherein one end of said resistor forming a part of said transistor switch means acts as said base current input terminal of said transistor switch means.

9. An ignition system as defined in claim 1 wherein said semiconductor switch comprises a thyristor.

10. An ignition system as defined in claim 1 wherein said semiconductor switch comprises a transistor.

11. An ignition system as defined in claim 1 wherein said signal generating circuit includes a signal generating coil adapted to generate a turn-on signal at an igniting position of the engine.

12. An ignition system as defined in claim 1 wherein said signal generating circuit comprises a divider circuit which divides an output of said igniting exciter coil and supplies a turn-on signal to said semiconductor switch at an igniting position of the engine.

13. An ignition system as defined in claim 1 wherein said coil is wound onto an armature core disposed in a magneto generator or in a signal generator provided separately from said magneto generator.

* * * * *